United States Patent [19]

Homma

[11] Patent Number: 4,817,481

[45] Date of Patent: Apr. 4, 1989

[54] VEGETABLE CUTTING DEVICE

[75] Inventor: Shinobu Homma, Tokyo, Japan

[73] Assignee: Kabushiki Kaisha Honma, Tokyo, Japan

[21] Appl. No.: 169,175

[22] Filed: Mar. 8, 1988

Related U.S. Application Data

[63] Continuation of Ser. No. 88,006, Aug. 18, 1987, abandoned, which is a continuation of Ser. No. 821,665, Jan. 23, 1986, abandoned, which is a continuation-in-part of Ser. No. 599,036, Apr. 11, 1984, Pat. No. 4,602,543.

[30] Foreign Application Priority Data

May 19, 1983 [JP] Japan ..... 58-073718

[51] Int. Cl.[4] ..... B02C 18/24

[52] U.S. Cl. ..... 83/355; 241/92

[58] Field of Search ..... 83/355, 356.1, 401, 83/431, 437, 703; 241/92, 282.1, 282.2; 269/95; 248/362

[56] References Cited

U.S. PATENT DOCUMENTS 3,904,164 9/1975 Wheeler et al. ..... 248/362
4,095,751 6/1978 Artin ..... 241/92
4,194,697 3/1980 Lembeck ..... 241/92
4,546,684 10/1985 Bellerose ..... 83/355
4,602,543 7/1986 Homma ..... 83/355

FOREIGN PATENT DOCUMENTS 183931 11/1982 Japan .
174072 12/1934 Switzerland ..... 241/92

*Primary Examiner*—Frank T. Yost
*Assistant Examiner*—Hien H. Phan
*Attorney, Agent, or Firm*—Sprung Horn Kramer & Woods

[57] ABSTRACT

A cutting device for cutting a vegetable and the like including a cup-shaped lower housing, an inverted cup-shaped upper housing with a connecting apparatus for connecting these housings, a cutter disk arranged in the lower housing, and a fixing apparatus attached to the lower housing. These housings, the disk, and the fixing apparatus can be disassembled from one another. The upper housing can be detached from the lower housing by releasing the connecting apparatus. The manually operated cutter disk can be lifted and removed from the lower housing. The lower housing also can be disassembled from the fixing apparatus, which has a sucker member operated by a lever.

12 Claims, 10 Drawing Sheets

VEGETABLE CUTTING DEVICE

This application is a continuation of application Ser. No. 088,006, filed Aug. 18, 1987, now abandoned, which is a continuation of Ser. No. 821,665, filed Jan. 23, 1986, now abandoned, which is a continuation-in-part application of U.S. patent application Ser. No. 599,036 filed Apr. 11, 1984 and now U.S. Pat. No. 4,602,543.

BACKGROUND OF THE INVENTION

1. Field of the Invention

The present invention relates to a device for cutting or slicing vegetables such as carrots, radishes, cabbages, and the like, the device being operated manually.

2. Description of the Prior Art

A conventional cutting device normally comprises a cup-shaped housing, a cutter disk provided at an opening portion of the housing and rotatable about the axis of the housing, a cover mounted on the opening portion, and a manually operated handle connected to the cutter disk and supported by the cover. A vegetable to be cut is supplied to an upper face of the cutter disk, and is cut in such a manner that the cut pieces remain in the housing. The cover, the cutter disk, and the housing can be disassembled, to enable the cut pieces of vegetable to be removed and for washing the housing and the cutter disk.

Thus, the cutting device must be able to be easily assembled for cutting a vegetable, and easily disassembled for removing the cut pieces of vegetable from the housing, and for washing the housing and other parts of the device.

SUMMARY OF THE INVENTION

An object of this invention is to provide a vegetable cutting device that is easily assembled and disassembled.

According to the present invention, there is provided a vegetable cutting device comprising a cup-shaped lower housing, an inverted cup-shaped upper housing, a connecting means, a cutter disk, a drive means, and a fixing apparatus.

The lower housing has an upper peripheral portion, while the upper housing has a lower pheripheral portion which is engagable with the upper peripheral portion of the lower housing. The upper housing has an inlet for inserting a vegetable to be cut.

The connecting means detachably interconnects the lower peripheral portion of the upper housing and the upper peripheral portion of the lower housing.

The cutter disk is detachably arranged in the lower housing and rotatable about the axis of the lower housing. The upper face of the cutter disk faces the inlet for inserting the vegetable, and the lower face of the cutter disk defines a storage chamber in an interior of the lower housing beneath the cutter disk. The cutter disk has a bore extending along the axis of the lower housing, and has at least one cutter blade.

The drive means has a manually operated drive shaft which is rotatably supported by the upper housing. The shaft has a lower engaging portion which is non-rotatably and detachably fitted into the bore of the cutter disk.

The fixing apparatus is attached to a bottom face of the lower housing, and fixes the lower housing onto a base plate.

The present invention may be more fully understood from the description of preferred embodiments of the invention set forth below, together with the accompanying drawings.

DESCRIPTION OF THE PREFERRED EMBODIMENTS

Figure 1:
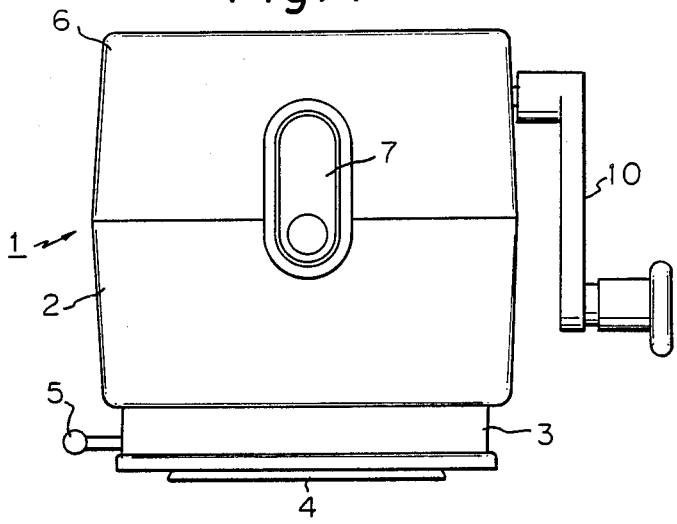
FIG. 1 is a side view of an embodiment of the present invention.
Figure 2:
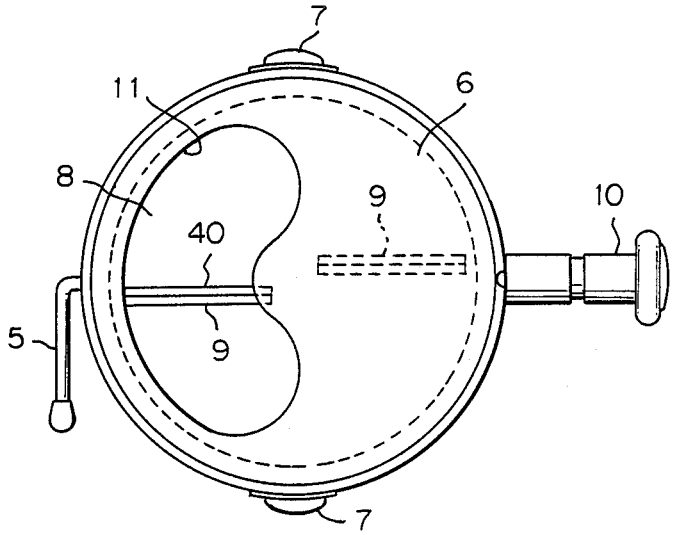
FIG. 2 is a plan view of FIG. 1.

FIGS. 1 to 16 show a cutting device according to an embodiment of the present invention. Referring to FIGS. 1 and 2, a cutting device is generally indicated by reference numeral 1. A cup-shaped lower housing 2 for storing cut pieces of vegetable is mounted on a fixing apparatus 3 which fixes the lower housing 2 onto a base plate by a sucker member 4 manually operated by a lever 5. An inverted cup-shape upper housing 6 is placed on the lower housing 2 and covers an opening thereof. The upper housing 6 is detachably interconnected to the lower housing 2 by a pair of connecting apparatuses 7. A cutter disk 8 fitted with cutter blades 9 is arranged in the lower housing 2. The cutter disk 8 is rotatable about the central axis of the lower housing, and is rotated by a handle 10 attached outside of the upper housing 6. An inlet 11 is formed in the upper housing 6 for supplying the vegetable to be cut to the cutter disk 8.

Figure 3:
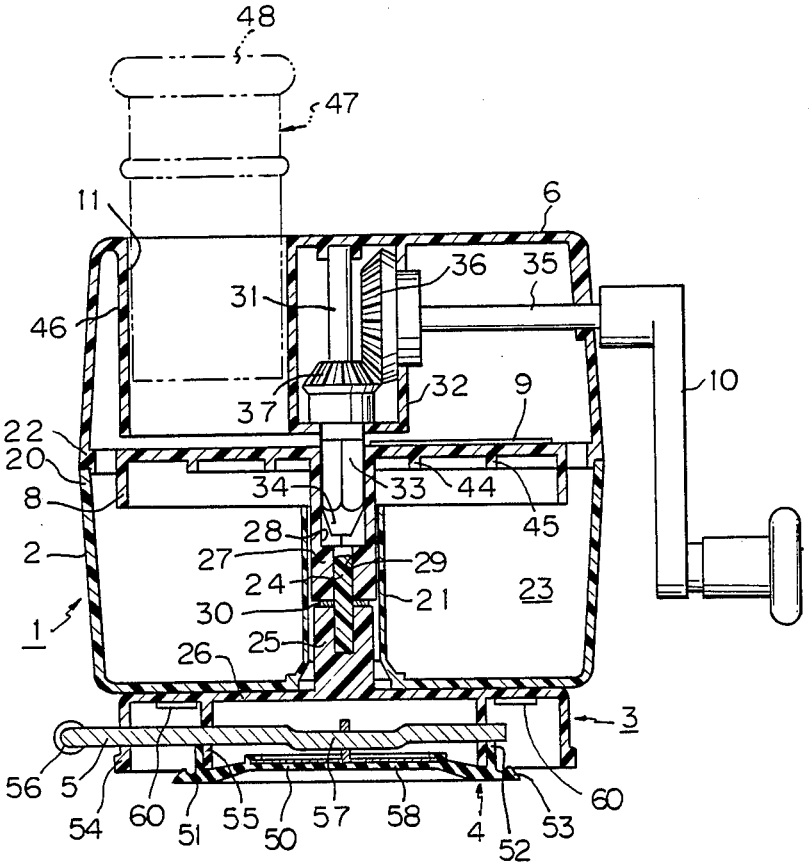
FIG. 3 is a sectional view of FIG. 1.
Figure 4:
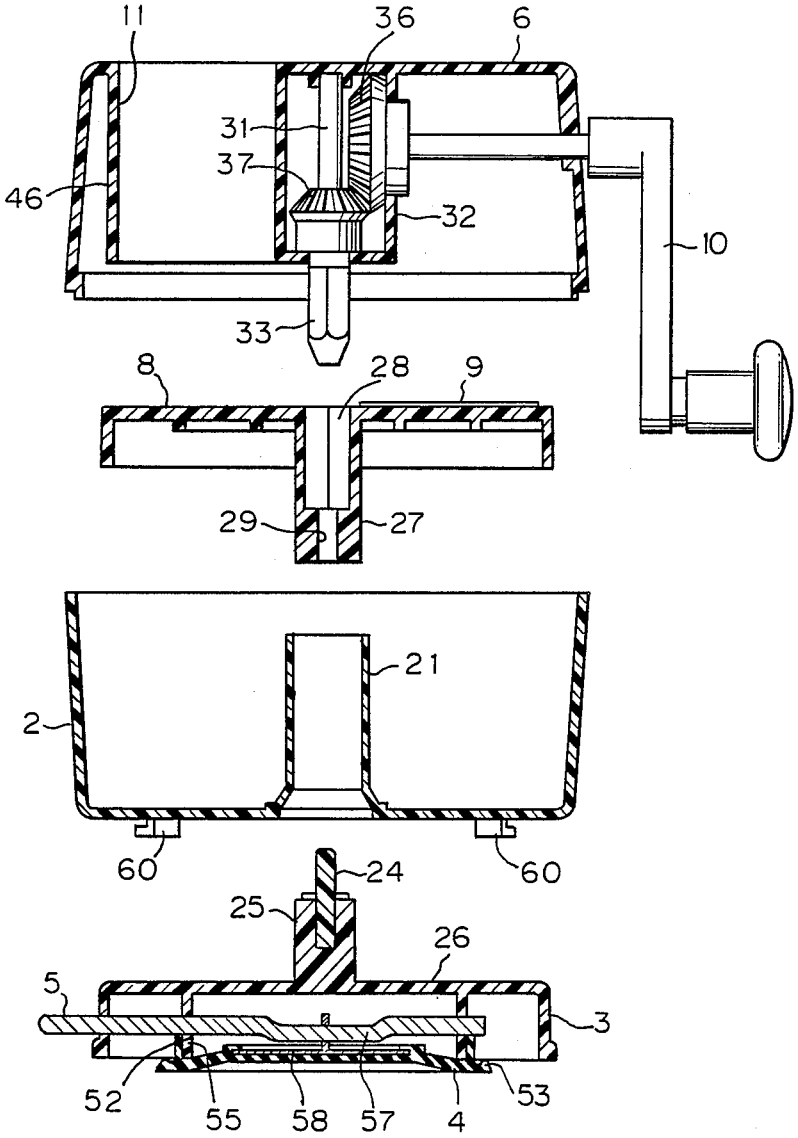
FIG. 4 is a sectional view of an embodiment of the present invention in a partially disassembled state.

FIG. 3 shows a sectional view of the cutting device 1, and FIG. 4 shows the same in a disassembled state. The lower housing 2 has an upper peripheral portion 20 which defines the opening, and has a tubular guide 21 which surrounds the axis of the housing. A lower peripheral portion 22 of the upper housing 6 is engagable with the inside of the upper peripheral portion 20, and the lower peripheral portion 22 is fixed to the upper peripheral portion 20 by the connecting apparatus 7.

The cutter disk 8 is detachably arranged at the opening of the lower housing 2, and a lower face thereof defines a storage chamber 23 in an interior of the lower housing 2. The cutter disk 8 is rotably supported by a pin 24 mounted on a projection 25 formed on an upper plate of a casing 26 of the fixing apparatus 3. That is, the cutter disk 8 has a downward extending spindle 27 in which a bore 28 and a hole 29 are formed, while the projection 25 extends toward the hole 29 and the pin 24 rotatably engages with the hole 29. Thus, the pin 25 extends along the axis of the lower housing 2, and is inserted into the hole 29, which has a diameter smaller than that of the bore 28. The cutter disk 8 is detachable from the pin 24. A washer 30 is inserted between the spindle 27 and the projection 25, to reduce friction therebetween. The tubular guide 21 surrounds the spindle 27 and the projection 25.

The cutter disk 8 is driven by the handle 10 to rotate about the axis of the lower housing 2. For this purpose, a first drive shaft 31 is rotatably supported by a box 32 formed in the upper housing 6. The drive shaft 31 has a lower engaging portion 33 which is non-rotatably and detachably fitted into the bore 28 of the cutter disk 8. That is, the lower engaging portion 33 has a polygonal cross-section (e.g., a square cross-section), and the bore 28 has the correspondent cross-section (see FIG. 5). Therefore, when the drive shaft 31 is rotated by the handle 10, at least one flat surface of the lower engaging portion 33 engages with a flat surface of the bore 28, so that the shaft 31 rotates the cutter disk 8. Note, the lower engaging portion 33 has a tapered end portion 34 which converges downward so that the lower engaging portion 33 is easily inserted into the bore 28.

The handle 10 is rotatably attached to a side wall of the upper housing 6. A second drive shaft 35 connected to the handle 10 is provided with a second bevel gear 36 which is housed in the box 32 and engages with a first bevel gear 37 fixed onto the first drive shaft 31. Thus, a drive means is constructed from the first and second drive shafts 31, 35, the first and second bevel gears 37, 36, and the handle 10.

Figure 5:
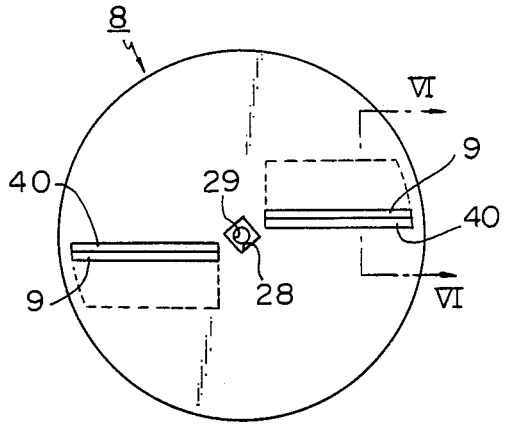
FIG. 5 is a plan view of a cutter disk.
Figure 6:
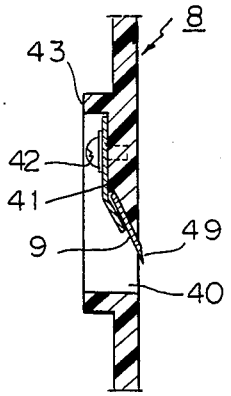
FIG. 6 is a sectional view along line VI—VI of FIG. 5.

A pair of slots 40 are formed in the cutter disk 8, these slots extend in a substantially radial direction, as shown in FIG. 5. Each cutter blade 9 is arranged in the slots 40, respectively, and is fixed to a lower face of the disk 8 by a retainer plate 41 and a screw 42, as shown in FIG. 6. A cutting edge 49 of the cutter blade 9 projects from the upper surface of the cutter disk 8 in such a manner that the edge 49 will cut or slice a vegetable. The retainer plate 41 is supported by a rim 43 formed on the lower face of the disk 8. The cutter disk 8 has annular ribs 44, 45 which protrude from the lower face thereof. These ribs 44, 45 are concentric with and provide rigidity to the disk 8.

The upper housing 6 has a downward extending tubular wall 46 terminating in the vicinity of an upper face of the disk 8. The tubular wall 46 defines the inlet 11, which the upper face of the disk 8 faces. The inlet 11 is formed at a half part of the upper housing 6, but is not formed at the box. Thus, the inlet 11 is opened along the rotational direction of the disk 8.

Figure 7:
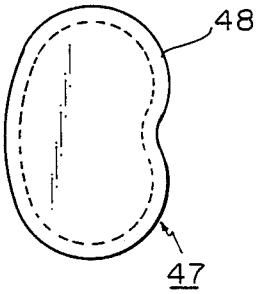
FIG. 7 is a plan view of a pushdown member.
Figure 8:
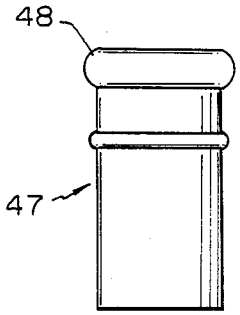
FIG. 8 is a side view of FIG. 7.

A pushdown member 47 may be provided for pressing a vegetable inserted in the inlet 11 onto the upper face of the cutter disk 8. The pushdown member 47 is formed into a shape that conforms to the shape of the inlet 11, and has a head portion 48 for manual handling, as shown in FIGS. 7 and 8.

The fixing apparatus 3 comprises the casing 26, the sucker member 4, and the manual lever 5, as previously mentioned, and is attached to a bottom face of the lower housing 2 by inserting claws 60 formed on a bottom surface of the lower housing 2 into holes (not shown) opened in the casing 26.

The sucker member 4 is made of an elastic material such as a rubber, and is formed into an inverted disk-shape. The sucker member 4 has a concave central portion 50 and a ring-shaped peripheral flat portion 51, a lower surface of which will make a sealed contact with a base plate. An upper surface of the flat portion 51 is supported by the casing 26 so that the lower surface of the flat portion 51 makes a sealed contact with the base plate. The sucker member 4 is formed with an upward extending first annular rib 52 in contact with the casing 26, and an upward extending second annular rib 53 radially and outwardly spaced from the first annular rib 52.

The casing 26 has a downward extending enclosure 54 at a peripheral portion, and a downward extending annular wall 55 inside of the enclosure 54. A lower end portion of the annular wall 55 is in contact with the upper face of the flat portion 51 of the sucker member 4, and an outer surface of the annular wall 55 is engaged with the inside of the first annular rib 52.

Figure 9:
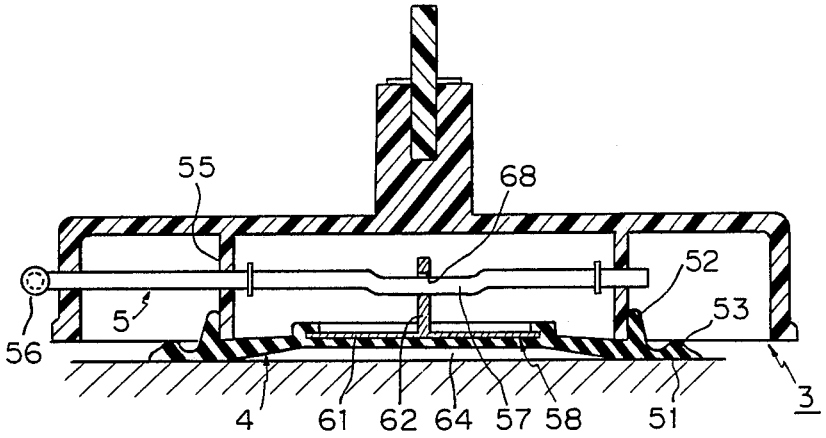
FIG. 9 is a sectional view showing the fixing apparatus in a non-operative state.
Figure 10:
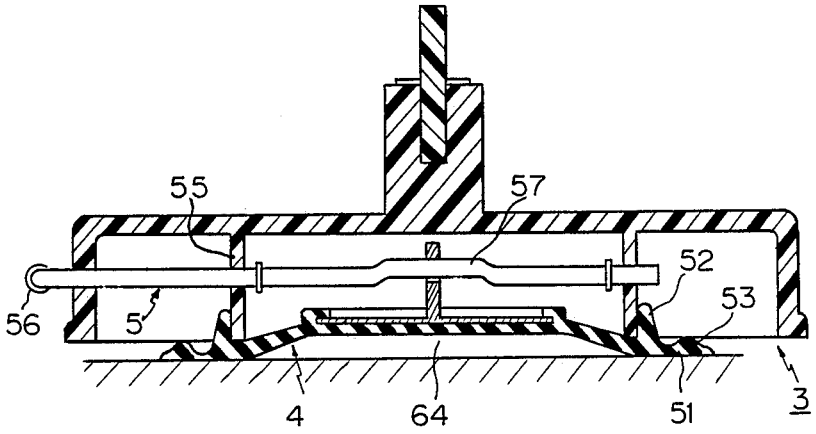
FIG. 10 is a sectional view showing the fixing apparatus in an operative state wherein it fixes the lower housing onto a base plate.

The manual lever 5 penetrates the annular wall 55, and a knob 56 of the lever 5 projects from the enclosure, whereby the lever 5 is rotably supported by the casing 26. The manual lever 5 has a crank portion 57 connected to a joint member 58 fixed to the central portion of the sucker member 4. As shown in FIGS. 9 and 10, the joint member 58 has a disk plate 61 fixed to the central portion of the sucker member 4 and a projection 62 extending upward on the disk plate 61, and a hole 63 is formed in the projection 62. The crank portion 57 of the lever 5 is inserted in the hole 63 of the joint member 58. The lever 5 actuates the central portion up and down as follows.

FIG. 9 shows a state in which the central portion of the sucker member 4 is lowered, that is, the fixing apparatus 3 is not operative. In this state, the crank portion 57 is located in a lower position so that the joint member 58, i.e., the central portion of the sucker member 4 is lowered. Consequently, a space 64, defined by the sucker member 4 and the base plate, has a relatively small volume. To the contrary, if the lever 5 is rotated about 180°, the crank portion 57 is moved upward so that the central portion of the sucker member 4 is raised, as shown in FIG. 10. Accordingly, the volume of the space 64 is enlarged so that a vacuum is formed in the space 64, and the flat portion 51 of the sucker member 4 makes a sealed contact with the base plate, whereby the fixing apparatus 3 sticks to the base plate. In this operation, since the first annular rib 52 engages with the outer surface of the wall 55, the flat portion 51 does not move inwards, and, since the flat portion 51 has a relatively wide breadth and is formed with the second annular rib 53, the rigidity of the flat portion 51 is increased and the flat portion 51 is placed in firm contact with the base plate, and will not separate from the base plate. The fixing apparatus 3 is released from the base plate by rotating the lever 5 to a position shown in FIG. 9.

As mentioned above, the cutting device comprises the upper housing 6, the cutter disk 8, the lower housing 2, and the fixing apparatus 3, and these components can be disassembled as shown in FIG. 4. The upper housing 6 is removed from the lower housing 2 and the cutter disk 8 by releasing the connecting apparatuses 7 (see FIG. 1, described in detail hereinafter) and drawing the engaging portion 33 from the bore 28 of the cutter disk 8. The cutter disk 8 is removed by lifting it off of the pin 24. The lower housing 2 is detached from the fixing apparatus 3 by drawing the claws 60 from the holes formed in the casing 26. In this disassembling operation, the fixing apparatus 3 may remain in sealed contact with the base plate.

Since the cutter disk 8 can be detached from the lower housing 2, and the lower housing 2 can be removed from the fixing apparatus 3, any cut pieces of vegetable stored in the lower housing 2 are easily removed, and it is easy to wash the lower housing 2 after use.

The cutting device can be quickly re-assembled by mounting the lower housing 2 on the fixing apparatus 3, arranging the cutter disk 8 in the lower housing 2, and engaging the upper housing with the lower housing 2.

The cutter disk 8 is easily changed for another kind of cutter disk according to the purpose for which the device will be used. The spindle 27 is rotatably supported by the projection 25 and the pin 24, and the bore 28 is engaged with the lower engaging portion 33 of the drive shaft 31. That is, the cutter disk 8 is supported at two points, ensuring a stable rotation of the cutter disk 8 when cutting a vegetable.

Note, the lower housing 2, the upper housing 6, the disk 8, the casing 26, the pin 24, the bevel gears 36, 37, the lower engaging portion 33 of the shaft, the handle 10, and the pushdown member 47 are all made of plastic.

Figure 11:
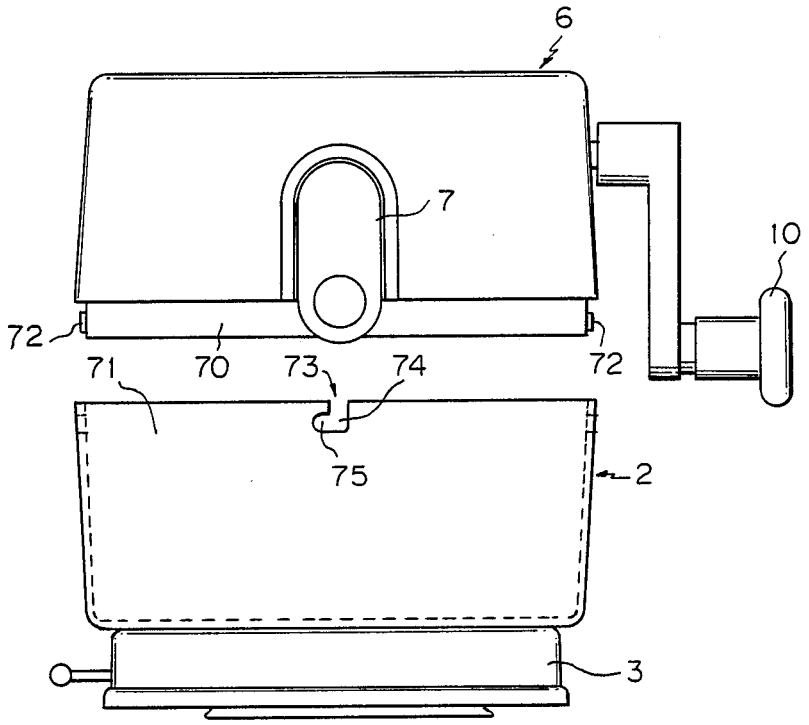
FIG. 11 is a side view showing the upper housing separated from the lower housing.

FIG. 11 to 16 show the construction and operation of the connecting apparatus 7. Referring to FIG. 11, after mounting the lower housing 2 on the fixing apparatus 3, and arranging the cutter disk (not shown) in the lower housing 2, the lower peripheral portion 70 of the upper housing 6 is fitted into the upper peripheral portion 71 of the lower housing 2. First the projection 72 formed on the lower peripheral portion 70 engage with L-shaped slots 73 formed on the upper peripheral portion 71, by moving the upper housing 6 downward along the axis thereof. The L-shaped slot 73 has a substantially vertical portion 74 and a substantially horizontal portion 75, and the projection 72 enters the vertical portion first. The upper housing 6 is then slightly rotated about the axis thereof, in relation to the lower housing 2, so that the connecting apparatuses 7 lock both the housings 2 and 6, as described later.

Figure 12:
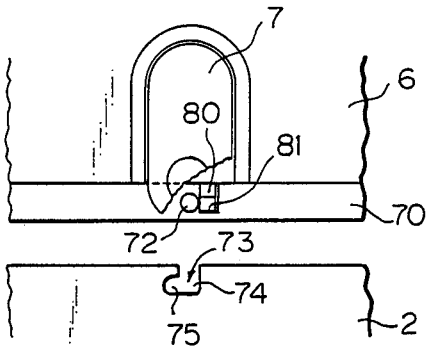
FIG. 12 is a front view of a connecting apparatus.
Figure 13:
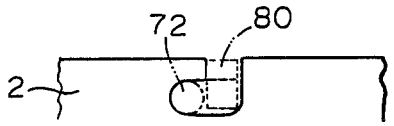
FIG. 13 is a front view of an L-shaped slot.

A pair of connecting apparatuses 7 are mounted on the upper housing 6 at opposite sides (see FIG. 2), respectively, and prevent the projections 72 from being dislodged from the L-shaped slots 73. The connecting apparatus 7 has a pawl 80 engagable with the vertical portion 74 of the L-shaped slot 73. The pawl 80 is located in the upper housing 6, and projects therefrom through an opening 81 formed in the lower peripheral portion 70, so that the pawl 80 engages with the vertical portion 74 of the L-shaped slot 73, as shown in FIGS. 12 and 13.

Figure 14:
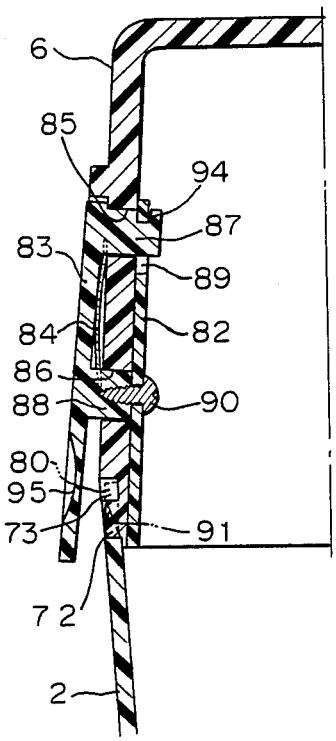
FIG. 14 is a sectional view showing the connecting apparatus interconnecting the upper housing and the lower housing.
Figure 15:
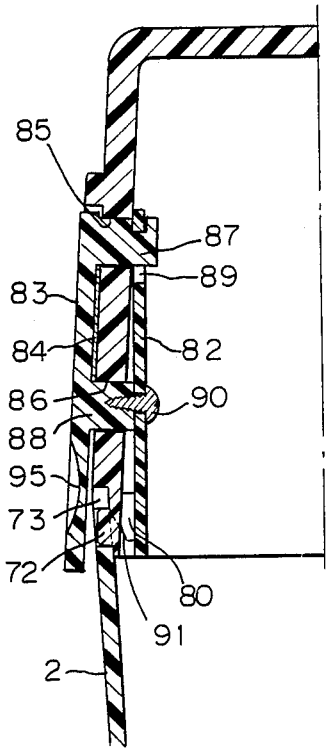
FIG. 15 is a sectional view showing a pawl of the connecting apparatus dislodged from the L-shaped slot.

The connecting apparatus 7 comprises an inner member 82 arranged on an inner wall of the upper housing 6, an outer member, i.e., a manual lever 83 arranged on an outer wall of the upper housing 6, and a plate-shaped spring 84 inserted between the upper housing 6 and the manual lever 83, as shown in FIGS. 14 and 15. While the upper housing 6 is formed with a first hole 85 and a second hole 86 vertically aligned with and spaced downward from the first hole 85, the manual lever 83 has a first connecting rod member 87 and a second connecting rod member 88 extending through the first hole 85 and the second hole 86, respectively. The first connecting rod member 87 engages with an opening 89 formed in the inner member 82, and the second connecting rod member 88 is fixed to a surface of the inner member 82 by a screw 90, whereby the manual lever 83 and the inner member 82 are interconnected to each other. The inner member 82 and manual lever 83 are pivotally supported on the upper housing 6 with respect to the first connecting rod member 87, and are biased outwardly by the plate spring 84.

Figure 16:
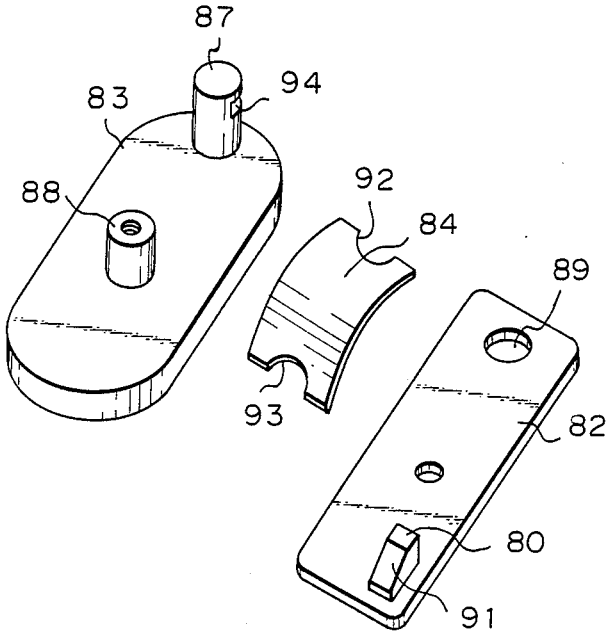
FIG. 16 is a perspective view of the connecting apparatus when disassembled.

The pawl 80 is formed on the inner member 82 as shown in FIG. 16, and is located beneath the second connecting rod member 88. The pawl 80 has an inclined surface 91 directed downward, so that the pawl 80 can slide on an inner surface of the lower housing 2 when the upper housing 6 is fitted in the lower housing 2.

The plate spring 84 is bent into an arc-like shape in a free state, as shown in FIG. 16. The plate spring 84 has, at opposed ends thereof, a first cutaway portion 92 and a second cutaway portion 93, which are engagable with the first connecting rod member 87 and the second connecting rod member 88, respectively. The spring 84 is mounted between the manual lever 83 and the upper housing 6 so that a convex surface of the spring 84 is in contact with the manual lever 83.

To assemble the connecting apparatus 7, first the plate spring 84 is attached to the manual lever 83, and then the lever 83 with the spring 84 attached is mounted on the upper housing 6; the first and second rod members 87, 88 being inserted in the first and second holes 85, 86, respectively. Next, the opening 89 is engaged with the rod member 87, and an inner periphery of the opening 89 is fitted in a notch 94 of the rod member 87, then the inner member 82 is fixed to the second rod member 88 by the screw 90.

In a non-operative state, the connecting apparatus 7 is biased outward so that a lower end of the manual lever 83 is situated away from the lower peripheral portion of the upper housing 6, and the pawl 80 is projected through the opening 81. The manual lever 83 is longer than the inner member 82, so the pawl 80 is hidden by the lower end of the lever 83 (see FIG. 12).

When the upper housing 6 is engaged with the lower housing 2, first, the projection 72 is fitted to the vertical portion 74 of the L-shaped slot 73, then the upper housing 6 is rotated until the pawl 80 engages with the horizontal portion 74 of the L-shaped slot 73 and the projection 72 enters the horizontal portion 75 of the slot 73. In this state, the pawl 72 prevents the upper housing 6 from rotating relative to the lower housing 2, so that the projection 72 remains engaged with the L-shaped slot 73 to prevent the upper housing 6 from being removed from the lower housing 2.

On the other hand, when the upper housing 6 is disengaged from the lower housing 2, the manual lever 83 is manually pushed toward the upper housing 6, against the spring 84, as shown in FIG. 15. As a result, the pawl 80 is released from the L-shaped slot 73, as shown in FIG. 15, and the upper housing 6 is rotated so that the projection 72 engages with the vertical portion 74 of the L-shaped slot 73. The upper housing 6 is then moved upward while the projection 72 is guided by the vertical portion 74, and the housing 6 is detached from the lower housing 2. Note, a depression 95 may be formed at a lower portion of the manual lever 83 to facilitate manual pushing.

Figure 17:
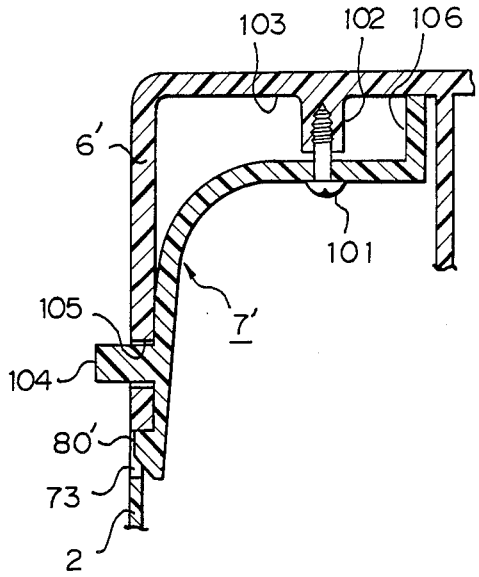
FIG. 17 is a sectional view showing another embodiment of the connecting apparatus.

FIG. 17 shows another construction of the connecting apparatus 7'. In this construction, the connecting apparatus 7' is made of an elastic material and formed in one body. The connecting apparatus 7' is housed in the upper housing 6' and fixed by a screw 101 to a protrusion 102 formed on a ceiling surface 103 of the upper housing 6'. The pawl 80' is formed on the lower end portion of the connecting apparatus 7' so as to engage with the L-shaped slot 73. A button 104 is formed on an upper portion of the pawl 80' to project through a hole 105 formed in the upper housing 6'. A middle portion of the connecting apparatus 7' is bent to extend along an inner surface of the upper housing 6'. The upper end portion is formed with an engaging tongue 106 extending toward and coming into contact with the ceiling surface 103.

When the upper housing 6' is fitted to the lower housing 2, the pawl 80' is engaged with the L-shaped slot 73 and the button 104 protruded from the hole 105, by the elasticity of the connecting apparatus 7. When the upper housing 6' is to be disengaged from the lower housing 2, pressure is exerted on the button 104 so that the pawl 80' is released from the L-shaped slot 73. Then the upper housing 6 is rotated so that the protrusion 72 (FIGS. 12 and 13) is released from the L-shaped slot 73, and the upper housing 6' is disassembled from the lower housing 2.

While embodiments of the present invention have been described herein with reference to the attached drawings, many modifications and changes may be made by those skilled in this art without departing from the scope of the invention.

While embodiments of the present invention have been described herein with reference to the attached drawings, many modifications and changes may be made by those skilled in this art without departing from the scope of the invention.

What is claimed is:

1. A cutting device used on a base plate for cutting a vegetable and the like, said device comprising:

a cup-shaped lower housing having a central axis and an upper peripheral portion, an inverted cup-shaped upper housing having a lower peripheral portion which is engageable with the upper peripheral portion of said lower housing, said upper housing having an inlet, a connecting means for detachably inter-connecting the lower peripheral portion of said upper housing and the upper peripheral portion of said lower housing, a cutting disk detachably arranged in said lower housing and rotatable about the axis of said lower housing, said disk having an upper face which faces said inlet and having a lower face which defines a storage chamber in an interior of said lower housing beneath said disk, said disk having a bore extending along the axis of said lower housing, and said disk having at least one cutter blade, a drive means having a manually operated drive shaft which is rotatably supported by said upper housing, said shaft having a lower engaging portion which is detachably fitted into the bore of said disk and which is non-rotatable relative to said disk to drive the disk while preventing any upward movement thereof, a fixing apparatus attached to a bottom face of said lower housing, and fixing said lower housing onto the base and wherein said disk has a downward extending portion having a hole therein, a pin disposed along the axis of the lower housing and rotatably engaged in said hole, wherein said fixing apparatus has a projection which extends toward the hole, and wherein said pin is mounted on said projection whereby the disk is rotatably supported from below by the pin to prevent downward movement of the disk.

2. A cutting device according to claim 1, wherein said lower engaging portion of said drive shaft has at least one flat surface, said bore having at least one flat surface which is engagable with the flat surface of said lower engaging portion of the drive shaft.

3. A cutting device according to claim 2, wherein said lower engaging portion of said drive shaft has a polygonal cross-section, and said bore has a polygonal cross-section.

4. A cutting device according to claim 2, wherein said lower engaging portion has a tapered end portion which converges downward.

5. A cutting device according to claim 1, wherein said lower housing has a tubular guide which surrounds said downward extending portion and said projection.

6. A cutting device according to claim 1, wherein said disk comprises at least one substantially radially extending slot, said cutting blade being arranged in the slot in such a manner that a cutting edge projects from an upper surface of said disk.

7. A cutting device according to claim 1, wherein said drive means comprises a first bevel gear fixed onto said drive shaft, a second bevel gear rotatably arranged in said upper housing and engaging with said first bevel gear, and a manual handle connected to said second bevel gear.

8. A cutting device according to claim 1, wherein said upper housing has a downward extending tubular wall terminating in the vicinity of the upper face of said disk and defining said inlet therein.

9. A cutting device according to claim 1, further comprising a pushdown member which is manually pushed into said inlet for pressing the vegetable onto the upper face of said disk.

10. A cutting device according to claim 1, wherein said fixing apparatus comprises a casing, an inverted dish-shaped sucker member made of an elastic material and having a concave central portion and a ring-shaped peripheral flat portion, and a manual lever connected to said central portion for actuating said central portion up and down, said peripheral portion having a lower surface which is able to maintain a sealed contact with the base plate, and having an upper face supported by said casing.

11. A cutting device according to claim 10, wherein said casing has a downward extending annular wall having a lower end portion which is in contact with said upper face of said peripheral portion, said sucker member having a first annular rib which engages with an outer surface of said annular wall, and having an upward extending second annular rib which is radially outward spaced from said first annular rib.

12. A cutting device according to claim 10, wherein said lever is rotatably supported by said casing, and has a crank portion connected to said central portion of said sucker member.

* * * * *